US009389554B2

(12) United States Patent
Tanaka et al.

(10) Patent No.: US 9,389,554 B2
(45) Date of Patent: Jul. 12, 2016

(54) IMAGE FORMING APPARATUS DISCRIMINATING WHETHER IMAGE HEATING DEVICE IS FOR HEATING AN ENVELOPE AND SYSTEM WITH DISPLAY PORTION CONFIGURED TO DISPLAY A DISPLAY PROMPTING AN OPERATOR TO MOUNT IMAGE HEATING DEVICE FOR AN ENVELOPE

(71) Applicant: CANON KABUSHIKI KAISHA, Tokyo (JP)

(72) Inventors: Kenichi Tanaka, Abiko (JP); Taiya Hirayama, Moriya (JP); Shutaro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/722,503

(22) Filed: May 27, 2015

(65) Prior Publication Data

US 2015/0346658 A1 Dec. 3, 2015

(30) Foreign Application Priority Data

May 29, 2014 (JP) ..... 2014-111047

(51) Int. Cl.
*G03G 15/20* (2006.01)

(52) U.S. Cl.
CPC ..... *G03G 15/2039* (2013.01); *G03G 15/2021* (2013.01); *G03G 2215/00514* (2013.01); *G03G 2215/0129* (2013.01); *G03G 2215/2006* (2013.01); *G03G 2215/2019* (2013.01)

(58) Field of Classification Search
CPC ..... G03G 15/2039
USPC ..... 399/67, 122, 401
See application file for complete search history.

(56) References Cited

U.S. PATENT DOCUMENTS 7,262,391 B2 8/2007 Nishihara et al.
7,263,303 B2 * 8/2007 Nakayama ..... G03G 15/2046 399/68

(Continued)

FOREIGN PATENT DOCUMENTS

JP 2005-0316046 11/2005
JP EP 1591843 A2 * 11/2005 ..... G03G 15/20
JP 2008-058365 3/2008

OTHER PUBLICATIONS

Copending, unpublished U.S. Appl. No. 14/721,206 to Shutaro Saito, et al., filed May 26, 2015.

(Continued)

*Primary Examiner* — Susan Lee
(74) *Attorney, Agent, or Firm* — Fitzpatrick, Cella, Harper & Scinto

(57) ABSTRACT

An image forming apparatus includes: an image forming device; a first image heating device; a second image heating device; a first feeding path configured to discharge the recording material introduced into the first image heating device without introducing the recording material into the second image heating device; a second feeding path configured to discharge a recording material introduced into the first image heating device and then introduced into the second image heating device; a discriminating portion configured to discriminate whether or not the first image heating device is an image heating device for an envelope; and a controller configured to effect control so as not to execute a heating operation of the second image heating device, upon discrimination of the first image heating device being the image heating device for the envelope by the discriminating portion.

17 Claims, 5 Drawing Sheets

(56) References Cited

U.S. PATENT DOCUMENTS

| | | | | |
|---|---|---|---|---|
| 7,356,300 | B2 | 4/2008 | Kamiyama | |
| 7,890,024 | B2 | 2/2011 | Hirayama et al. | |
| 7,890,038 | B2 | 2/2011 | Chikugo et al. | |
| 8,543,047 | B2 * | 9/2013 | Hosoi | G03G 15/2021 399/341 |
| 8,655,242 | B2 | 2/2014 | Tanaka | |
| 8,779,335 | B2 | 7/2014 | Saito | |
| 8,942,612 | B2 | 1/2015 | Tanaka | |
| 8,958,716 | B2 | 2/2015 | Saito | |
| 9,069,299 | B2 | 6/2015 | Tanaka | |
| 2005/0244203 | A1 | 11/2005 | Kamiyama | |
| 2005/0276624 | A1 * | 12/2005 | Fujino | G03G 15/2021 399/69 |
| 2006/0227205 | A1 * | 10/2006 | Nishihara | G03G 15/2039 347/194 |
| 2007/0217803 | A1 * | 9/2007 | Nakayama | G03G 15/2046 399/68 |
| 2007/0242970 | A1 * | 10/2007 | Fujino | G03G 15/2021 399/69 |
| 2013/0142534 | A1 * | 6/2013 | Isobe | G03G 15/20 399/67 |
| 2014/0153938 | A1 | 6/2014 | Saito | |
| 2015/0185670 | A1 | 7/2015 | Tanaka | |

OTHER PUBLICATIONS

Copending, unpublished U.S. Appl. No. 14/721,344 to Taiya Hirayama et al., filed May 26, 2015.

Copending, unpublished U.S. Appl. No. 14/722,279 to Kenichi Tanaka et al., filed May 27, 2015.

Shutaro Saito, et al., U.S. Appl. No. 14/721,206, filed May 26, 2015.

Taiya Hirayama et al., U.S. Appl. No. 14/721,344, filed May 26, 2015.

Kenichi Tanaka, et al., U.S. Appl. No. 14/722,279, filed May 27, 2015.

* cited by examiner

IMAGE FORMING APPARATUS DISCRIMINATING WHETHER IMAGE HEATING DEVICE IS FOR HEATING AN ENVELOPE AND SYSTEM WITH DISPLAY PORTION CONFIGURED TO DISPLAY A DISPLAY PROMPTING AN OPERATOR TO MOUNT IMAGE HEATING DEVICE FOR AN ENVELOPE

FIELD OF THE INVENTION AND RELATED ART

The present invention relates to a control device and an image forming apparatus for forming a toner image on a recording material. Examples of the image forming apparatus include, e.g., a copying machine, a printer, a facsimile machine and a multi-function machine having a plurality of functions of these machines.

In a conventional image forming apparatus of an electrophotographic type, a fixing device (image heating device) for fixing a toner image formed on a recording material by using an electrophotographic process is mounted thereon.

In order to meet a market demand for a device with an improved image forming speed, in an a image forming apparatus described in Japanese Laid Open Patent Application (JP A) 2005 316046 (corresponding to U.S. Pat. No. 7,356,300), two fixing devices are provided along a recording material feeding direction. Specifically, a constitution is provided in which fixing is performed using only one fixing device when the recording material is plain paper and is performed using the two fixing devices when the recording material is thick paper.

Further, in the market, the demand for image formation on an envelope has increased. In a conventional image forming apparatus, although the image can be formed on the envelope, there is a room for improvement with respect to the quality of the outputted product (i.e., there is a phenomenon that creases are generated when an image is formed on the envelope), so that the conventional image forming apparatus cannot completely meet the market demand.

Therefore, in an image forming apparatus described in JP A 2008 58365, a constitution is described in which in addition to a general-purpose fixing device (for a recording material other than the envelope), a fixing device for the envelope is prepared and in which when the image is formed on the envelope, the general-purpose fixing device is replaced with the fixing device for the envelope.

SUMMARY OF THE INVENTION

According to an aspect of the present invention, there is provided an image forming apparatus comprising: an image forming device configured to form a toner image on a recording material; a first image heating device configured to heat a toner image formed on the recording material by the image forming device; a second image heating device configured to heat the toner image heated by the first image heating device; a first feeding path configured to discharge the recording material introduced into the first image heating device without introducing the recording material into the second image heating device; a second feeding path configured to discharge the recording material after being introduced into the first image heating device and then being introduced into the second image heating device; a discriminating portion configured to discriminate whether or not the first image heating device is an image heating device for an envelope; and a controller configured to effect control so as not to execute a heating operation of the second image heating device, upon discrimination of the first image heating device being the image heating device for the envelope by the discriminating portion.

According to another aspect of the present invention, there is provided an image forming apparatus comprising: an image forming device configured to form a toner image on a recording material; a first image heating device configured to heat a toner image formed on the recording material by the image forming device; a second image heating device configured to heat the toner image heated by the first image heating device; a first feeding path configured to discharge the recording material introduced into the first image heating device without introducing the recording material into the second image heating device; a second feeding path configured to discharge the recording material after being introduced into the first image heating device and then being introduced into the second image heating device; a discriminating portion configured to discriminate whether or not the first image heating device is an image heating device for an envelope; and a controller configured to effect control so as to prohibit use of the second image heating device, upon discrimination of the first image heating device being the image heating device for the envelope by the discriminating portion.

According to a further aspect of the present invention, there is provided an image forming system comprising: an image forming device configured to form a toner image on a sheet; a first image heating device configured to heat a toner image formed on the sheet by the image forming device; a second image heating device configured to heat the toner image heated by the first image heating device; a first feeding path configured to discharge the sheet introduced into the first image heating device without introducing the sheet into the second image heating device; a second feeding path configured to discharge the sheet after being introduced into the first image heating device and then being introduced into the second image heating device; and a display portion configured to display for prompting an operator to mount an image heating device for an envelope in place of the first image heating device when image formation on the envelope is effected.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described, but although the following embodiments are examples of preferred embodiments, the present invention is not limited to the following embodiments.

Embodiment 1

General Structure of Image Forming Apparatus

Figure 2:
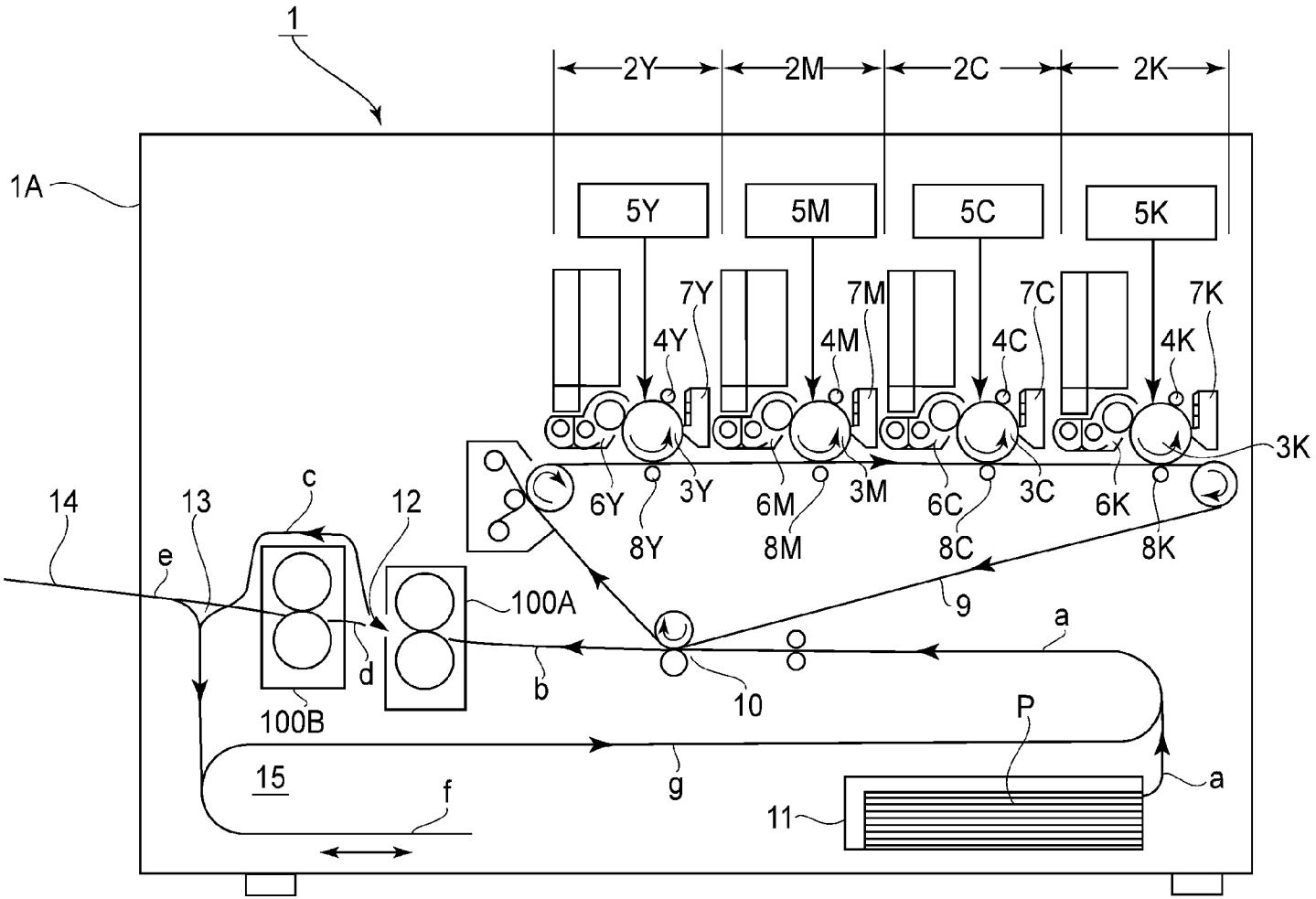
FIG. 2 is a schematic view showing a structure of an image forming apparatus.

FIG. 2 is a schematic view showing a general structure of an image forming apparatus 1 in this embodiment. This image forming apparatus 1 is an electrophotographic full-color printer which is of a tandem fixing type and an intermediary transfer type and which has a both-side image forming function. Inside an apparatus main assembly (image forming apparatus main assembly) 1A of the image forming apparatus 1, e.g., four image forming portions 2Y, 2M, 2C and 2K corresponding to Y (yellow), M (magenta), C (cyan) and K (black) are disposed in series as an image forming device. That is, as the image forming device, a tandem type device is provided in which a fixing process is performed until a visible image is formed in parallel among the respective colors of Y, M, C and K.

In order to prevent a cumbersome description, the four image forming portions for the respective colors of Y, M, C and K will be described by representing these portions as a symbol "2", and this is similarly applied to the following associated process means. Further, the order of arrangement of the image forming portions 2 for the respective colors of Y, M, C and K is not limited to the above order.

At each of the image forming portions 2, the following respective electrophotographic process means are provided. That is, an image bearing member (electrophotographic photosensitive drum) 3 for bearing an electrostatic latent image on a surface thereof correspondingly to an associated one of the colors of Y, M, C and K, a primary charger 4, an exposure device 5, a developing device 6 and a cleaning device 7 are provided.

The primary charger 4 electrically charges the surface of an associated image bearing member 3 uniformly by applying a charging bias voltage having a set potential. The surface of the image bearing member 3 is exposed to light by the exposure device 5 correspondingly to an image information pattern, so that the electrostatic latent image is formed. The electrostatic latent image is developed with a toner (developer) by the developing device 6, thus being changed into a visible image as a toner image.

Toner images of the respective colors of Y, M, C and K which are formed and carried on the surfaces of the image bearing members 3 of the respective image forming portions 2 are successively primary-transferred superposedly onto an endless belt as an intermediary transfer member 9 by a primary transfer device 8. A primary transfer residual toner on each of the image bearing members 3 is removed by the cleaning device 7.

An unfixed full-color toner image formed on the intermediary transfer member 9 by superposing the toner images of all the colors of Y, M, C and K is collectively secondary-transferred by a secondary transfer device 10 onto a recording material P as a recording medium fed to the secondary transfer device 10.

The recording material P may include, as a sheet, an envelope in addition to plain paper, coated paper, thick paper, and thin paper. In the image forming apparatus 1 in this embodiment, a feeding member for a sheet cassette 11 accommodating the recording materials P is driven, so that one of the recording materials P in the cassette is separated and fed to the secondary transfer device 10 through a feeding path a.

In the following, an example in which the image is formed on the sheet as the recording material P is shown. With respect to the sheet, such as the thick paper or the coated paper, requiring a large heat quantity, as described later, fixing is made using two fixing devices. Accordingly, speed-up of the image formation can be realized while satisfying a fixing property. On the other hand, with respect to the sheet, such as the plain paper, requiring a small heat quantity compared with the cases of the thick paper and the coated paper, the fixing is made using only one fixing device. Incidentally, as described later, in the case where the envelope is used as the recording material, the fixing is made using only one fixing device.

First and second fixing devices (image heating devices) 100A and 100B are provided along a feeding direction of the recording material. The recording material P having passed through the secondary transfer device 10 is separated from the intermediary transfer member 9 and is introduced into the first fixing device 100A by being passed through a feeding path b, so that the toner image on the recording material is heated and fixed. Into the second fixing device 100B, the sheet coming out of the first fixing device 100A is introduced by selection, and the second fixing device 100B heats the image on the sheet heated by the first fixing device 100A.

The image forming apparatus 1 is operable in use (operation) modes for the first and second fixing devices 100A and 100B described above. The use modes include a first control mode in which the recording material P from the secondary transfer device 10 (a part of the image forming device) is introduced into the first fixing device 100A but is not introduced into the second fixing device 100B and a second control mode in which the recording material P is introduce into the first fixing device 100A and then is introduced into the second fixing device 100B. Further, the image forming apparatus 1 is capable of selectively executing operations in the first and second control modes.

In the case of the operation in the first control mode, the recording material P coming out of the first fixing device 100A is guided to a feeding path c side by a flapper 12 as a switching member. This feeding path c is a feeding path which circumvents the second fixing device 100B, so that the recording material P reaches a feeding path e without being introduced into the second fixing device 100B, and then is discharged as an image-formed product onto a discharge tray 14.

In the case of the operation in the second control mode, the recording material coming out of the first fixing device 100A is guided to a feeding path d side by the flapper 12. This feeding path d is a feeding path leading to the second fixing device 100B, so that the recording material P is introduced from the first fixing device 100A into the second fixing device 100B and reaches the feeding path e, and then is discharged as the image-formed product on the discharge tray 14.

In the case of a double-side image forming mode, the recording material P which passes through the feeding path c toward the feeding path e and on which the image has already been formed on a first surface or the recording material P which comes out of the first fixing device 100A and on which the image has already been formed on the first surface is changed in course to a double-side feeding path mechanism 15 side by a flapper 13. Then, the recording material P is fed in a switch-back manner after being fed into a feeding path f of the mechanism 15, and is fed again into the feeding path a via a feeding path g in an upside-down state, thus being fed to the secondary transfer device 10. As a result, the secondary transfer of the toner image from the intermediary transfer member 9 onto a second surface of the recording material P is made.

Therefore, similarly as in the case of the one-side image forming mode, the recording material P is discharged, as an image-formed product on which the image is formed on both (first and second) surfaces, onto the discharging tray 14.

(Fixing Device)

In this embodiment, basic constitutions of the first and second fixing devices 100A and 100B are the same.

Figure 1:
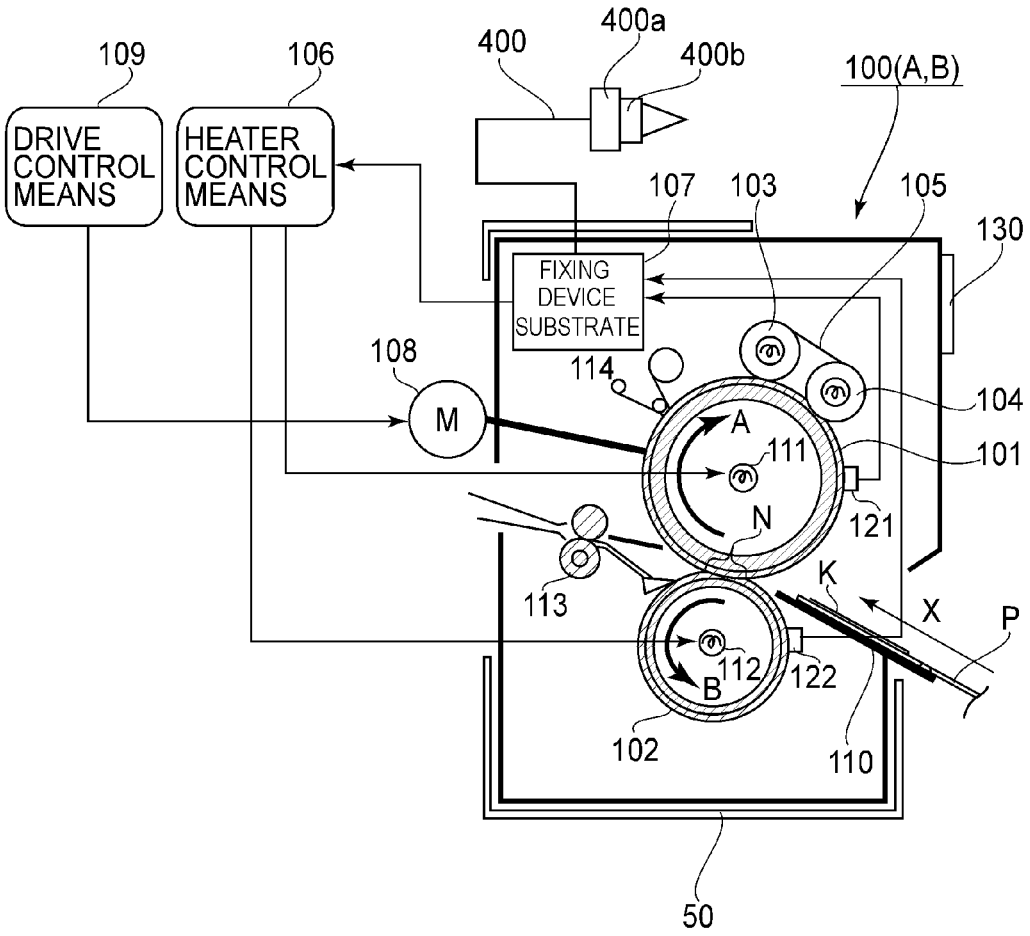
FIG. 1 is a schematic view of a fixing device.

FIG. 1 is an enlarged cross-sectional schematic view of the fixing device 100 (100A, 100B).

The fixing device 100 includes a pair of rotatable members for forming a nip (fixing nip) N where the recording material P carrying thereon an unfixed toner image K is nipped and fed, i.e., a fixing roller (fixing member) 101 and a pressing roller (pressing member) 102. Further, the fixing device 100 includes an external heating belt 105 rotatably stretched by first and second supporting rollers 103 and 104. Further, the fixing device 100 includes a web cleaning device 114 for cleaning the surface of the fixing roller 101.

The fixing roller 101 is prepared by forming a parting layer of a heat-resistant resin material on an outer peripheral surface of a metal core and is rotationally driven in the clockwise direction of an arrow A at a predetermined peripheral speed by a driving motor (driving mechanism) 108 controlled with respect to a rotational speed by a drive control means (motor controller) 109. Inside the metal core of the fixing roller 101, a halogen heater 111 as an internal heat generating element is provided, and heats the fixing roller 10 in combination with the external heating belt 105 so that the surface temperature of the fixing roller 101 is a predetermined temperature.

The pressing roller 102 is prepared by forming a heat-resistant elastic layer on an outer peripheral surface of a metal core, and is disposed substantially in parallel to the fixing roller 101. Further, by an unshown pressing means, the pressing roller 102 is pressed toward the fixing roller 101 at a predetermined pressure against elasticity of the elastic layer, so that the fixing nip N having a predetermined width with respect to the feeding direction X of the recording material P is formed between itself and the fixing roller 101.

The pressing roller 102 is rotated by the rotational drive of the fixing roller 101 in the counterclockwise direction of an arrow B at a peripheral speed corresponding to the peripheral speed of the fixing roller 101. Inside the metal core of the pressing roller 102, a halogen heater 112 as the heat generating element is provided, so that the pressing roller 102 is heated from an inside thereof so that the surface temperature of the pressing roller 102 is a predetermined temperature.

The surface temperature of the fixing roller 101 is detected by a thermistor 121 as a temperature detecting means contacting the fixing roller 101. The surface temperature of the pressing roller 102 is detected by a thermistor 122 contacting the pressing roller 102. Electrical signals relating to the temperatures outputted from the thermistors 121 and 122 are once collected by an electric substrate (fixing device substrate, electrostatic circuit substrate) 107 provided in the fixing device 100, and thereafter are inputted into a heater control means 106 as a temperature control (adjusting) means.

The heater control means 106 turns on and off the respective halogen heaters 111 and 112 on the basis of detected temperatures of the thermistors 121 and 122, respectively, so that the heater control means 106 controls the heaters so that each of the surface temperature of the fixing roller 101 and the surface temperature of the pressing roller 102 is the predetermined temperature.

The electric substrate 107 also has the following functions in addition to the temperature detection of the thermistors 121 and 122. That is, the electric substrate 107 also has the function of controlling drive of a motor for operating an unshown pressing means and the function of collecting signal lines and power lines which are used for operating a sensor for detecting positions (pressing state position and pressing-eliminated state position) of the pressing means.

The rotational drive of the fixing roller 101 and the following rotation of the pressing roller 102 with the rotation drive of the fixing roller 101 are made, and the surface temperatures of both of the rollers are increased up to the predetermined temperatures, so that temperature control is made. In this fixing device state, the recording material P which passed through the secondary transfer device 10 and which is fed into the first fixing device 100A is guided by a guiding member 110 into the nip N of the first fixing device 100A, and is nipped and fed. A carrying surface of the recording material P which is to be guided into the nip N and which carries the unfixed toner image K is directed upward, and faces the fixing roller 101.

In this way, by nipping and feeding the recording material P through the nip N, the unfixed toner image K is fixed as the fixed image on the recording material P under application of heat and pressure. The recording material P coming-out of the nip N is separated from the fixing roller 101 and the pressing roller 102, and is sent from the first fixing device 100A by a discharging roller pair 113 for the fixing device 100. The web cleaning device 114 wipes and removes an offset toner on the surface of the fixing roller 101. The external heating means (103, 104, 105) is provided upstream of the nip N and downstream of the web cleaning device 114 with respect to the fixing roller rotational direction.

The recording material P sent from the first fixing device 100A is, as described above, introduced into the feeding path c circumventing the second fixing device 100B in the case of the operation in the first control mode and is introduced into the second fixing device 100B in the case of the operation in the second control mode.

Of the first and second fixing devices 100A and 100B, at least the first fixing device 100A is detachably mounted as a fixing unit in a mounting portion (fixing device mounting portion) 50 of the apparatus main assembly 1A of the image forming apparatus 1 in a predetermined manner (procedure).

As the first fixing device 100A detachably mountable to the mounting portion 50 of the apparatus main assembly 1A, a general-purpose fixing device and an exclusive fixing device constituted by being specialized for a specific recording material are selectively used. Further, the first fixing device 100A is electrically and mechanically connected with the controller, an electric power supplying portion, a driving mechanism and the like in the apparatus main assembly 1 side in a predetermined manner in a state in which the first fixing device 100A is positionally fixed and mounted in the mounting portion 50, so that the first fixing device 100A receives supplied electric power and a driving force from the apparatus main assembly side.

The first fixing device 100A detachably mountable to the mounting portion 50 includes a discrimination information holding means capable of holding discrimination information indicating that the first fixing device 100A is the general-purpose fixing device (a fixing device capable of fixing the toner image on plain paper and thick paper other than the envelope) or discrimination indicating information that the first fixing device 100A is an envelop-only fixing device (a fixing device ensured to fix the image on the envelope).

Figure 3:
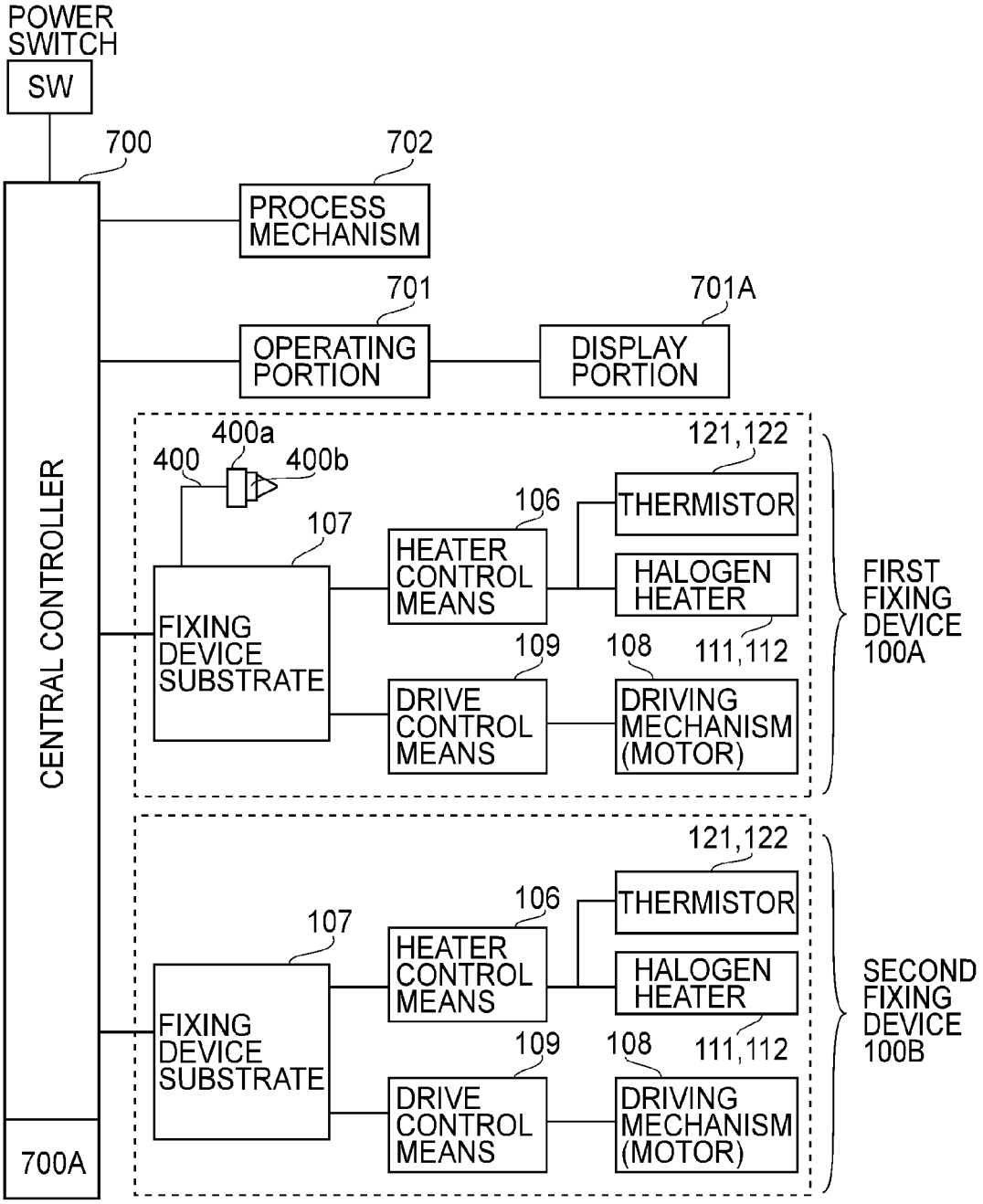
FIG. 3 is a block diagram of a control system.

In this embodiment, the holding means is, as shown in FIGS. 1 and 3, a discriminating short connector mountable to and demountable from the electric substrate 107 of the first fixing device 100A. That is, on end of a discriminating bundle wire 400 is connected to the electric substrate 107, and to the other end of the discriminating bundle wire, a relay connector 400*a* is connected. To the relay connector 400*a*, a discriminating short connector 400*b* is constituted so as to be mountable. The discriminating short connector 400*b* is used for discriminating the general-purpose fixing device and the envelop-only fixing device.

The second fixing device 100B is the general-purpose fixing device, and in the case where the first fixing device 100A is the general-purpose fixing device, the second fixing device 100B is used together with the first fixing device 100A by selection.

At a proper position of the fixing device 100, a discriminating member 130 (FIG. 1) including writing, of a species of device, indicating that the fixing device is the general-purpose fixing device or the envelop-only fixing device is provided, so that selection of the fixing device of a species to be used becomes easy.

(Control Device)

FIG. 3 is a block diagram of an outline of a control system of the image forming apparatus 1. A general printing operation (image forming operation) of an image forming process mechanism 702 of the image forming apparatus 1 is controlled by a central controller 700 controlled by CPU.

Figure 4:
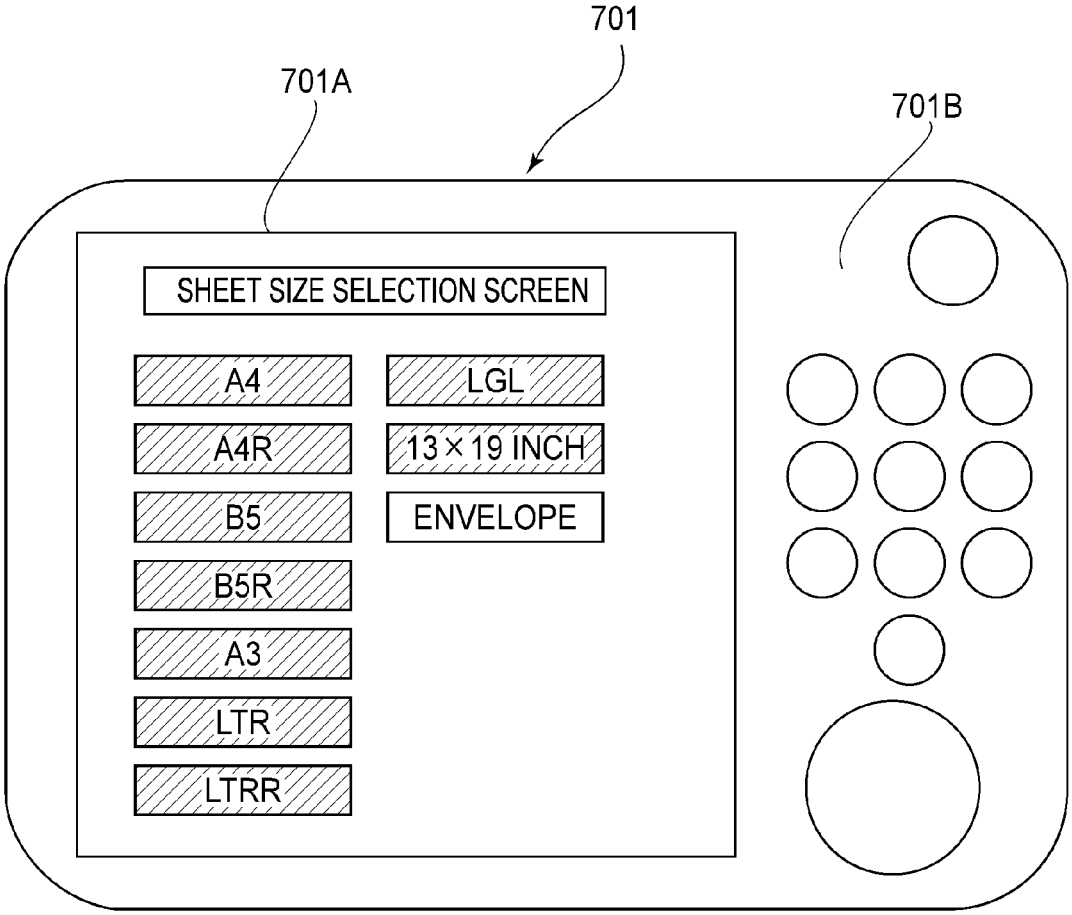
FIG. 4 is an illustration showing a sheet size setting screen when an envelop-only fixing device is mounted.

An operating portion 701 functions as an inputting means, of various pieces of information, such as a recording material size inputting means. The operating portion 701 includes a display portion (information display portion) 701A and an operating button portion 701B as shown in FIG. 4. At the operating button portion 701B, various settings of the printing operation performed by the image forming apparatus 1 are inputted. The display portion 701A is a liquid crystal screen of a touch panel type, and at the display portion 701A, not only display of various messages but also display of various operation buttons (keys) are made. Also by the displayed operation buttons, the various settings of the printing operation performed by the image forming apparatus 1 are inputted.

In the case where the image is intended to be formed on the envelope, the fixing device is required to be replaced from the general-purpose fixing device (a fixing device which is capable of meeting many species of recording materials and which is not ensured to form the image on the envelope) to the envelop-only fixing device (a fixing device which is capable of meeting only the envelope as a limited recording material and which is ensured to form the image on the envelope).

At this time, at the display portion 701A, a guidance message prompting the operator to replace the first fixing device 100A with the envelop-only fixing device in the mounting portion 50, i.e., in the position where the first fixing device 100A is mounted. This is because in order to have advantages described later, replacement with the envelop-only fixing device is prevented from being performed in a position where the second fixing device 100B is mounted.

The display of such a message is made controlling the display portion 701A by the controller 700. Specifically, the controller 700 effects control so that the above-described guidance message is displayed at the display portion 701A depending on selection of the "ENVELOPE" in the sheet size selection screen (FIG. 4). Incidentally, as the guidance message displayed at the display portion 701A, any sentence (message) may be used if the message to the above-described effect can be informed to the operator.

The electric substrate 107 is in an electrically connected state with the controller 700 of the apparatus main assembly 1A side in a state in which the first fixing device 100A is mounted in the mounting portion 50 of the apparatus main assembly 1 in a predetermined manner. Then, the discriminating portion 700A of the controller 700 discriminates, from the discrimination information holding means 400*b* provided in the first fixing device 100A, whether or not the first fixing device 100A mounted in the mounting portion 50 is the general-purpose fixing device or the exclusive fixing device constituted by being specialized for the envelope (i.e., the fixing device ensured to form the image on the envelope).

Then, the controller 700 controls the image forming operation on the basis of the discrimination result of the discriminating portion 700A. That is, in the case where the first fixing device 100A mounted in the mounting portion 50 is discriminated as the exclusive fixing device by the discriminating portion 700A, the controller 700 effects control so that temperature control (heating operation) and drive control (rotating operation) of the second fixing device 100B are not executed. In this case, an operation in the first control mode in which the recording material P is introduced into the first fixing device 100A but is not introduced into the second fixing device 100B is executed.

In the following, a description will be provided by taking, as an example, the case where the above-described exclusive fixing device is the envelop-only fixing device. The envelope has such a bag shape that a plurality of paper materials are superposed, and therefore such a problem that the plurality of the superposed paper materials are deviated relative to each other when the fixing is made and thus creases generate liable to occur compared with a general sheet. In order to effect good fixing while solving the problem, in the envelop-only fixing device, a shape of the pressing roller 102 and a pressing force (pressure) at the fixing nip N are changed to those optimally suited for the envelope. Table 1 shows compatibility between a fixing property and (prevention of) creases when a fixing condition is changed.

TABLE 1

| PS*1 (N) | FRT*2 (° C.) | FP*3 | CR*4 |
|---|---|---|---|
| 1200 | 170 | ○ | x |
| 600 | 170 | x | ○ |
| 600 | 180 | ○ | ○ |

*1"PS" is the pressure.
*2"FRT" is a fixing roller temperature.
*3"P" is the fixing property.
*4"CR" is the creases.

The fixing condition of 1200N in pressure and 170° C. in fixing roller member shown in the second row of Table 1 is a fixing condition set in the general-purpose. In this condition, although the fixing property can be satisfied, creases are generated. With respect to the generation of the creases, it turned out that when the pressure at the fixing nip N has sensitivity and is changed too 600N which is half of 1200N, the physical stress on the envelope is alleviated and thus the creases are not generated.

However, the fixing property is rather lowered, so that the required fixing property cannot be ensured, and thus improper fixing occurs. The fixing property has a tendency to be improved by increasing the fixing roller temperature, and therefore when the fixing of the image on the envelope was performed with setting of 600N in pressure and 180° C. in fixing roller temperature as shown in the lowest row of Table 1, it turned out that the image can be fixed with no generation of the creases while ensuring the fixing property.

From the above-described result, in the general-purpose fixing device, a device constitution in which the pressure is 1200N and the fixing roller temperature is 170° C. was employed. On the other hand, in the envelop-only fixing device, a fixing condition of 600N in pressure and 180° C. in fixing roller temperature was employed, and the envelop-only fixing device which included the pressing roller 102 changed in shape and a pressing spring for the pressure of 600N and which was different in specifications from the general-purpose fixing device was constituted.

Incidentally, in the case where the image is fixed on the envelope, when the envelope is passed through both the first fixing device 100A and the second fixing device 100B, the number of fixing steps in which the creases can be generated is increased, and therefore the above-described fixing condition was set so that a sufficient fixing property can be ensured by the first fixing device 100A alone.

Therefore, a constitution in which two species consisting of the general-purpose fixing device and the envelop-only fixing device are set as the first fixing device 100A and in which a single species consisting of the general-purpose fixing device is set as the second fixing device 100B was employed.

In the case where the image is fixed on the envelope, the envelop-only fixing device is provided as the first fixing device 100A and the general-purpose fixing device is provided as the second fixing device 100B, and the fixing is made by the first fixing device 100A. Then, the flapper 12 is controlled so that the envelope pass through the feeding path c (FIG. 2) along which the envelope does not pass through the second fixing device 100B and then is discharged to an outside of the device (first control mode).

In the case where the image is fixed on a sheet other than the envelope, there are two types consisting of the case where the fixing is made using only the first fixing device 100A (first control mode) and the case where the fixing is made using both the first fixing device 100A and the second fixing device 100B (second control mode). The proper use of these two modes is made using only the first fixing device 100A in the case where the image is fixed on the general sheet (first control mode) and using both the first and second fixing devices 100A and 100B with respect to the fixing of the image on the sheet, such as the thick paper or the coated paper, intended to be improved in glossiness of the image (second control mode). Section of this proper use can be made in a control mode selection screen (not shown) displayed by a screen operation at the display portion 701A of the operating portion 701.

A discriminating method of the general-purpose fixing device and the envelop-only fixing device will be described. Between the general-purpose fixing device and the envelop-only fixing device, a difference generates in device constitution and control, and therefore these fixing devices cannot be equivalently treated. Therefore, the discriminating short connector 400*b* is used. Specifically, the discriminating short connector 400*b* is not connected to the first fixing device 100A assembled as the general-purpose fixing device, but is connected to the first fixing device 100A assembled as the envelop-only fixing device.

The discriminating portion 700A of the controller 700 checks the presence or absence of electrical connection of the discriminating short connector 400*b* with the first fixing device 100A mounted in the mounting portion 50 to discriminate whether the mounted fixing device 100 is the general-purpose fixing device or the envelop-only fixing device, and then effects control. The discriminating short connector 400*b* is provided at a position where the user cannot touch the discriminating short connector 400*b*, and setting is made so that the user cannot arbitrarily change the mounted fixing device between the general-purpose fixing device and the envelop-only fixing device.

Control in the case where the envelop-only fixing device is provided as the first fixing device 100A will be described. In the case where the controller 700 recognizes that the envelop-only fixing device was provided as the first fixing device 100A, the second fixing device 100B is not used, and therefore in the control block diagram shown in FIG. 3, the controller 700 prohibits any control relating to the second fixing device 100B. That is, use of the second fixing device 100B is prohibited, and temperature control and drive control of the second fixing device 100 are not carried out.

Further, in order to realize a good fixing property, the controller 700 controls two heater control means 106 so that a control temperature of the fixing roller 101 of the first fixing device 100A is changed to 180° C.

FIG. 4 is an illustration showing an operation screen in which setting of the size of the passed sheet when the envelop-only fixing device is mounted as the first fixing device 100A in the mounting portion 50 is changed. In the case of the envelop-only fixing device, the passed sheet is limited to the envelope in the screen in which the size of the passed sheet is selected at the operating portion 701, setting is made so that sheet sizes other than the envelope are greyed out and thus cannot be selected. With respect to the above setting, the control is automatically changed by the controller 700 on the basis of the presence or absence of the discriminating short connector 400*b*, and therefore when the replacement of the fixing device is made in the image forming apparatus main assembly, the user is not required to perform a special operation.

By effecting the above control, in the case where the envelop-only fixing device is provided as the first fixing device 100A, only control of the second fixing device 100B is turned off. For that reason, electric power consumption required for warming up the second fixing device 100B and then for placing the second fixing device 100B in a stand-by state is reduced, so that it is possible to provide an energy-saved image forming apparatus.

A status that the second fixing device 100B is used from a state in which the control of the second fixing device 100B is turned off is that in the case where the sheet other than the envelope is passed, and therefore a replacing operation for replacing the first fixing device 100A from the envelop-only fixing device to the general-purpose fixing device always generates. At this time, the first fixing device 100A and the general-purpose fixing device with which the envelop-only fixing device is replaced are at normal temperature, and therefore with respect to subsequent warm-up, both the first fixing device 100A and the second fixing device 100B are under the same condition. Accordingly, by turning off the control of the second fixing device 100B, such a disadvantage that it takes much time to actuate (start up) the apparatus main assembly is not rather generated.

By employing the constitution described above, in the case where the fixing device is replaced with the envelop-only fixing device when the tandem fixing system is employed, it becomes possible to propose an image forming apparatus in which unnecessary electric power consumption is suppressed to save energy.

Incidentally, in this embodiment, an example of the envelop-only fixing device as the exclusive fixing device constituted by being specialized for the specific recording material was described.

Embodiment 2

The holding means, provided in the first fixing device 100A detachably mounted in the mounting portion 50, capable of holding the discrimination information indicating that the first fixing device 100A is the general-purpose fixing device or the discrimination information indicating that the first fixing device 100A is the exclusive fixing device is not limited to the discriminating short connector 400*b* in Embodiment 1.

Figure 5:
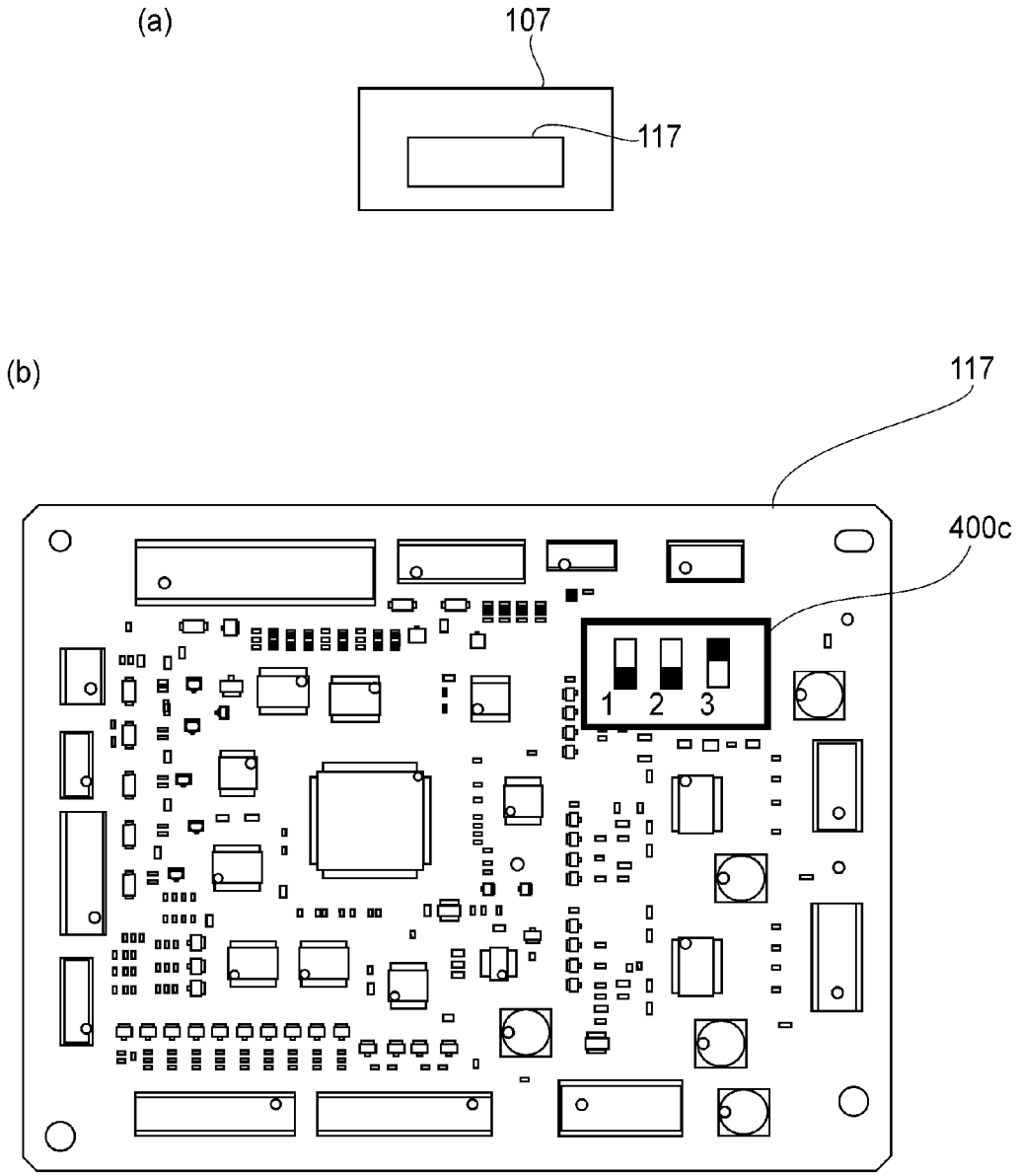
In FIG. 5, (a) and (b) are illustrations each showing another example for illustrating the envelop-only fixing device.

For example, as shown in (a) of FIG. 5, as the holding means a volatile or nonvolatile memory (storing means) 117 represented by ROM, RAM, flash memory is provided on the electric substrate 107 of the fixing device. It is also possible to employ a constitution in which the above-described discrimination information is stored (held) in the memory 117. The discriminating portion 700A discriminates the species of the fixing device by reading the discrimination information from the memory 117.

Further, the holding means can also be changed to a group of switches 400*c* capable of being switched with each other in a plurality of states of combinations as shown in (b) of FIG. 5. That is, in place of the above-described short connector 400*b*, it is also possible to use the group of the switches 400*c* such as DIP switches provided the electric substrate (board) 107. It is possible to discriminate the constitution of the fixing device by a combination of ON/OFF of the DIP switches 400*c*.

In the case of the short connector 400*b*, the short connector 400*b* can be used for discriminating the plurality of species of the fixing devices by a combination of signal lines to be short-circuited. The DIP switches 400*c* can be used for discriminating the plurality of species of the fixing devices by a combination of switches which are turned on or off.

As described above, Embodiments to which the present invention is applicable were described, but various constitutions can be replaced with other constitutions within the scope of the concept of the present invention.

For example, the image forming apparatus 1 is not limited to the color image forming apparatus, but may also be a monochromatic (single color) image forming apparatus for a monochromatic image or the like.

Further, for example, the fixing device 100 can also have a device constitution of a belt fixing type using an endless belt having flexibility as either one or both of the pair of rotatable members 102 and 102.

Further, the heating mechanism for the fixing device is not limited to the halogen heater. The heating mechanism can also have a device constitution employing other appropriate heating mechanisms such as a ceramic heater type or an electromagnetic induction heating type.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-111047 filed on May 29, 2014, which is hereby incorporated by reference herein in its entirety.

What is claimed is:

1. An image forming system comprising:

an image forming device configured to form a toner image on a sheet;

a first image heating device configured to heat a toner image formed on the sheet by said image forming device;

a second image heating device configured to heat the toner image heated by said first image heating device;

a first feeding path configured to discharge the sheet introduced into said first image heating device without introducing the sheet into said second image heating device;

a second feeding path configured to discharge the sheet after being introduced into said first image heating device and then being introduced into said second image heating device;

a display portion configured to display a display for prompting an operator to mount an image heating device for an envelope in place of said first image heating device when image formation on the envelope is effected; and a controller configured to control sheet feeding so that the envelope as the recording material is introduced into said first feeding path when the image formation on the envelope is effected.

2. An image forming system according to claim 1, wherein said controller controls said display portion for receiving an instruction to effect image formation on the envelope, wherein upon receiving the instruction to effect the image formation on the envelope, said controller effects a display for prompting the operator to mount the image heating device for the envelope in place of said first image heating device.

3. An image forming apparatus comprising:

an image forming device configured to form a toner image on a recording material;

a first image heating device configured to heat a toner image formed on the recording material by said image forming device;

a second image heating device configured to heat the toner image heated by said first image heating device;

a first feeding path configured to discharge the recording material introduced into said first image heating device without introducing the recording material into said second image heating device;

a second feeding path configured to discharge the recording material after being introduced into said first image heating device and then being introduced into said second image heating device;

a discriminating portion configured to discriminate whether or not said first image heating device is an image heating device for an envelope; and a controller configured to effect control so as not to execute a heating operation of said second image heating device, upon discrimination of said first image heating device being the image heating device for the envelope by said discriminating portion.

4. An image forming apparatus according to claim 3, further comprising a guiding member configured to guide the recording material heated by said first image heating device from said first feeding path to said second feeding path, wherein when said first image heating device is discriminated as the image heating device for the envelope by said discriminating portion, said controller effects control so that the envelope as the recording material is introduced into said first feeding path.

5. An image forming apparatus according to claim 4, wherein upon discrimination of said first image heating device not being the image heating device for the envelope by said discriminating portion, said controller effects control so that the heating operation of said second image heating device is executable.

6. An image forming apparatus according to claim 5, wherein when said first image heating device is not discriminated as the image heating device for the envelope by said discriminating portion, said controller executes the heating operation of said second image heating device during warm up.

7. An image forming apparatus according to claim 3, wherein the image heating device for the envelope includes a storing portion configured to store information indicating that it is an image heating device for an envelope, and said discriminating portion makes a discrimination on the basis of the information stored in said storing portion.

8. An image forming apparatus according to claim 3, further comprising a display portion configured to display a display for prompting an operator to designate a species of the recording material, wherein when said first image heating device is discriminated as the image heating device for the envelope, said controller controls said display portion so as to disable designation of the recording material as a recording material other than the envelope.

9. An image forming apparatus according to claim 3, wherein said first image heating device includes a first pair of rotatable members configured to form a nip for heating the toner image while nipping and feeding the recording material and includes a first heating device configured to heat said first pair of rotatable members, wherein said second image heating device includes a second pair of rotatable members configured to form a nip for heating the toner image while nipping and feeding the recording material and includes a second heating device configured to heat said second pair of rotatable members, and wherein upon the discrimination of said first image heating device being the image heating device for the envelope by said discriminating portion, said controller effects control so as not to execute a heating operation by said second heating device.

10. An image forming apparatus according to claim 9, wherein upon the discrimination of said first image heating device being the image heating device for the envelope by said discriminating portion, said controller effects control so as not to execute a rotating operation of said second pair of rotatable members.

11. An image forming apparatus comprising:

an image forming device configured to form a toner image on a recording material;

a first image heating device configured to heat a toner image formed on the recording material by said image forming device;

a second image heating device configured to heat the toner image heated by said first image heating device;

a first feeding path configured to discharge the recording material introduced into said first image heating device without introducing the recording material into said second image heating device;

a second feeding path configured to discharge the recording material after being introduced into said first image heating device and then being introduced into said second image heating device;

a discriminating portion configured to discriminate whether or not said first image heating device is an image heating device for an envelope; and a controller configured to effect control so as to prohibit use of said second image heating device, upon discrimination of said first image heating device being the image heating device for the envelope by said discriminating portion.

12. An image forming apparatus according to claim 11, further comprising a guiding member configured to guide the recording material heated by said first image heating device to one of said first feeding path and said second feeding path, wherein when said first image heating device is discriminated as the image heating device for the envelope by said discriminating portion, said controller effects control so that the envelope as the recording material is introduced into said first feeding path.

13. An image forming apparatus according to claim 12, wherein upon discrimination of said first image heating device not being the image heating device for the envelope by said discriminating portion, said controller permits the use of said second image heating device.

14. An image forming apparatus according to claim 13, wherein when said first image heating device is not discriminated as the image heating device for the envelope by said discriminating portion, said controller executes the heating operation of said second image heating device during warm up.

15. An image forming apparatus according to claim 11, wherein the image heating device for the envelope includes a storing portion configured to store information indicating that it is an image heating device for an envelope, and said discriminating portion makes a discrimination on the basis of the information stored in said storing portion.

16. An image forming apparatus according to claim 11, further comprising a display portion configured to display a display for prompting an operator to designate a species of the recording material, wherein when said first image heating device is discriminated as the image heating device for the envelope, said controller controls said display portion so as to disable designation of the recording material as a recording material other than the envelope.

17. An image forming apparatus according to claim 11, wherein said first image heating device includes a first pair of rotatable members configured to form a nip for heating the toner image while nipping and feeding the recording material and includes a first heating device configured to heat said first pair of rotatable members, wherein said second image heating device includes a second pair of rotatable members configured to form a nip for heating the toner image while nipping and feeding the recording material and includes a second heating device configured to heat said second pair of rotatable members, and wherein upon the discrimination of said first image heating device being the image heating device for the envelope by said discriminating portion, said controller prohibits an heating operation by said second heating device and a rotating operation of said second pair of rotatable members.

* * * * *